US006978789B2

(12) United States Patent
Garbarino

(10) Patent No.: US 6,978,789 B2
(45) Date of Patent: Dec. 27, 2005

(54) CONVERTIBLE COMPACT CIGARETTE MAKING MACHINE

(75) Inventor: Gary Garbarino, Montreal (CA)

(73) Assignee: EFKA Canada Limited, Quebec (CA)

( * ) Notice: Subject to any disclaimer, the term of this patent is extended or adjusted under 35 U.S.C. 154(b) by 433 days.

(21) Appl. No.: 10/409,189

(22) Filed: Apr. 9, 2003

(65) Prior Publication Data

US 2004/0200485 A1 Oct. 14, 2004

(51) Int. Cl.[7] ..... A24C 5/02
(52) U.S. Cl. ..... 131/70; 131/75
(58) Field of Search ..... 131/70–75

(56) References Cited

U.S. PATENT DOCUMENTS 4,771,793 A 9/1988 Kastner
6,206,006 B1 * 3/2001 Schutze et al. ..... 131/70
6,345,624 B1 * 2/2002 Kastner ..... 131/70

* cited by examiner

*Primary Examiner*—Dionne A. Walls
(74) *Attorney, Agent, or Firm*—Cantor Colburn LLP

(57) ABSTRACT

A compact cigarette making machine for inserting a quantity of tobacco into a preformed cigarette tube is described. A tobacco receiving member is slidably retained within a base and movable longitudinally thereon to load tobacco into a cigarette tube secured to a nipple at its forward end. A cover is pivotally secured to the rearward end of the tobacco receiving member and slidable therewith with respect to the base. The cover is pivotally movable from an open position to a closed position overlying the tobacco receiving member. The cover is substantially of the same width as the base and has a pair of opposed inner tongues engagable under a respective elongated flange which projects inside the open channel-shaped base from opposed side walls thereof when the tobacco receiving member is retracted rearwardly over the base. An arresting member is provided in the bottom wall of the machine to permit the loading of tobacco in tubes of different length.

12 Claims, 7 Drawing Sheets

CONVERTIBLE COMPACT CIGARETTE MAKING MACHINE

TECHNICAL FIELD

The present invention relates to a small, lightweight injection type cigarette making machine wherein a supply of tobacco is compacted into cylindrical form, and is injected into a preformed cigarette tube positioned on the machine wherein the machine is adaptable to make cigarettes of different lengths.

BACKGROUND ART

The cigarette making machine of the present invention is an improvement of the machine described in my earlier U.S. Pat. No. 4,771,793 issued on Sep. 20, 1988. This patent is the closest known prior art. No machines of this type are known wherein at last two different lengths of cigarettes can be formed with the same machine.

SUMMARY OF INVENTION

Some of the features of the present invention are to provide a cigarette making machine which is very compact, easy to assemble, uses minimal plastic material in its fabrication and which can easily be customized. The machine has a streamlined elongated rectangular body which easily fits in the hand of the user and is operable with a single hand, if desired. It can make at last two different lengths of cigarettes by a simple length adjustment feature.

According to the above feature of the present invention there is provided a compact cigarette making machine for compacting and inserting a quantity of tobacco into a preformed cigarette tube. The machine comprises a base of upwardly open channel-shape and having forward and rearward ends and an elongate tobacco injection spoon having a free end and having a concave cross-section secured at a predetermined elevated position within the base and stationary therewith. A tobacco receiving member is slidably retained within the base and movable to a position extending longitudinally outwardly from the rearward end of the base. The tobacco receiving member has at its forward end a wall carrying a hollow circular nipple to receive the open end of a preformed cigarette tube. The free end of the injection spoon passes through the hollow nipple during rearward movement of the tobacco receiving member with respect to the base. Abutment means is associated with the rearward end of the base to arrest the travel of the tobacco receiving member. An elongate slot is provided in and extends through the tobacco receiving member to receive a quantity of tobacco. A cover is pivotally secured to the rearward end of the tobacco receiving member and slidable therewith with respect to the base. The cover is pivotally movable from an open position to a closed position overlying the tobacco receiving member. A tobacco compacting projection is also provided and has a lower surface which is concave in transverse cross section and is carried by the cover and closes the top portion of the elongated slot when the cover is in closed position to compact tobacco inserted in the slot and onto the tobacco receiving member. A cigarette tube retainer is also provided and has a circular concave surface on the cover forwardly of the tobacco compacting projection. The concave surface of the retainer bears against the cigarette tube positioned on the nipple to hold the tube in position during tobacco injection. Retaining means are provided in a lower portion of the base for slidingly engaging the tobacco receiving member. The cover has a pair of opposed inner tongues engagable under a respective elongated projection inside the open channel-shaped base from opposed side walls thereof when the tobacco receiving member is retracted rearwardly over the base. An arresting means is disposed over an inner surface of the bottom wall and spaced from the rearward end thereof for contact with an arresting projection of the tobacco receiving member to shorten the rearward displacement of the tobacco receiving member whereby cigarette tubes of a shorter predetermined length can be used with the same cigarette making machine.

According to a further broad aspect of the present invention the arresting means is constituted by a removable abutment insert which is positionable in an aperture formed in the bottom wall and spaced from the rearward end thereof.

According to a still further broad aspect of the present invention the arresting means is constituted by a pivotal stop member having two arresting surfaces and pivotally secured over an inner surface of the bottom wall on a pivot. Adjustment means is provided to displace the pivotal stop member on the pivot to position one of the two arresting surfaces for arresting contact with the abutment means whereby to accommodate cigarette tubes of differing lengths.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
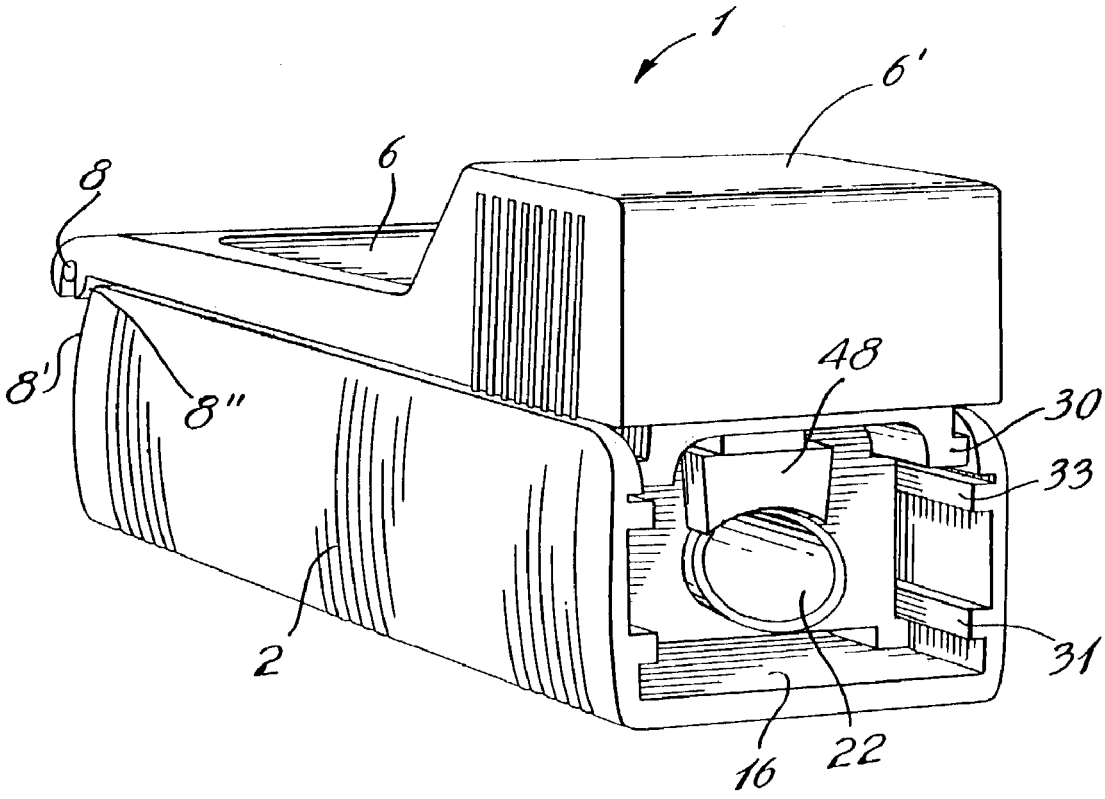
FIG. 1 is a perspective frontal view of the cigarette making machine of the present invention.
Figure 2:
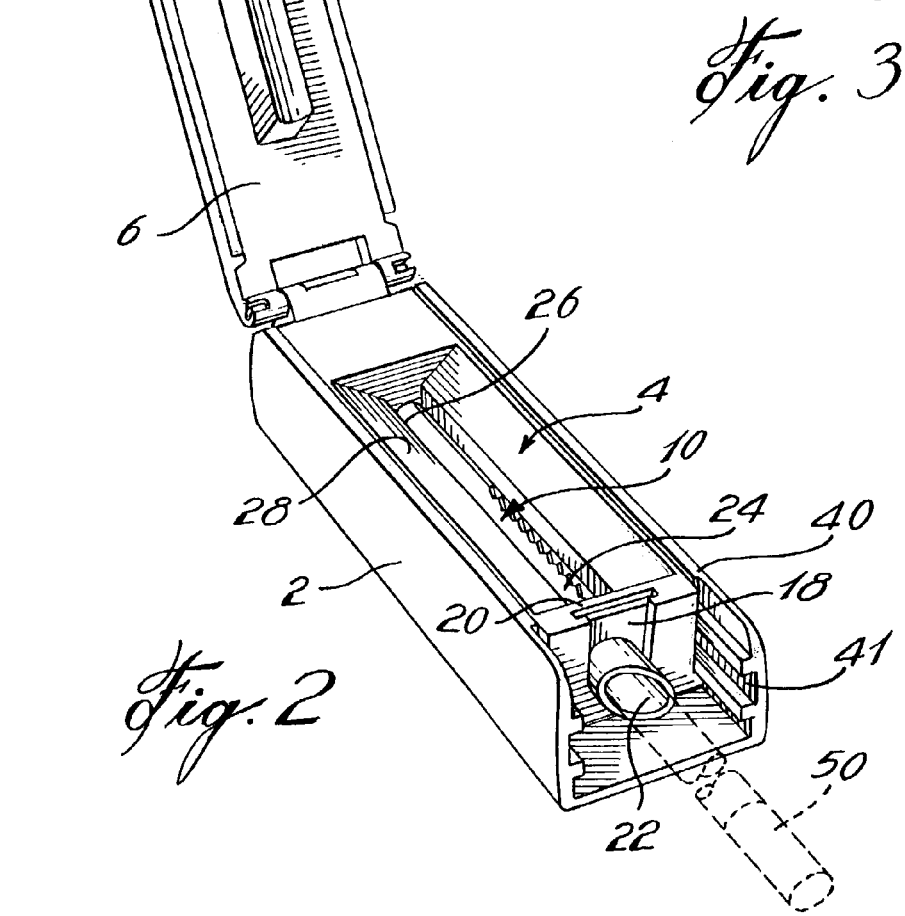
FIG. 2 is a perspective view showing the cigarette making machine in a loading position with the cover hinged outwardly.

With reference primarily to FIGS. 1 to 4, the cigarette making machine 1 consists of three major component parts comprising a hollow channel-shaped base 2, a tobacco receiving member 4 which is slidably movable in the base 2 from the forward position shown in FIG. 2 to a rearwardly retractable position as demonstrated in the prior art patent referred to above. A cover portion 6 is pivotally hinged to the rear of the tobacco receiving member 4 by suitable means such as pivot pin 8.

These three component parts 2, 4 and 6 may conveniently be molded of suitable plastics material for economy of manufacture, although other materials such as metals could be used if desired. However, plastics is the preferred material.

Figure 5:
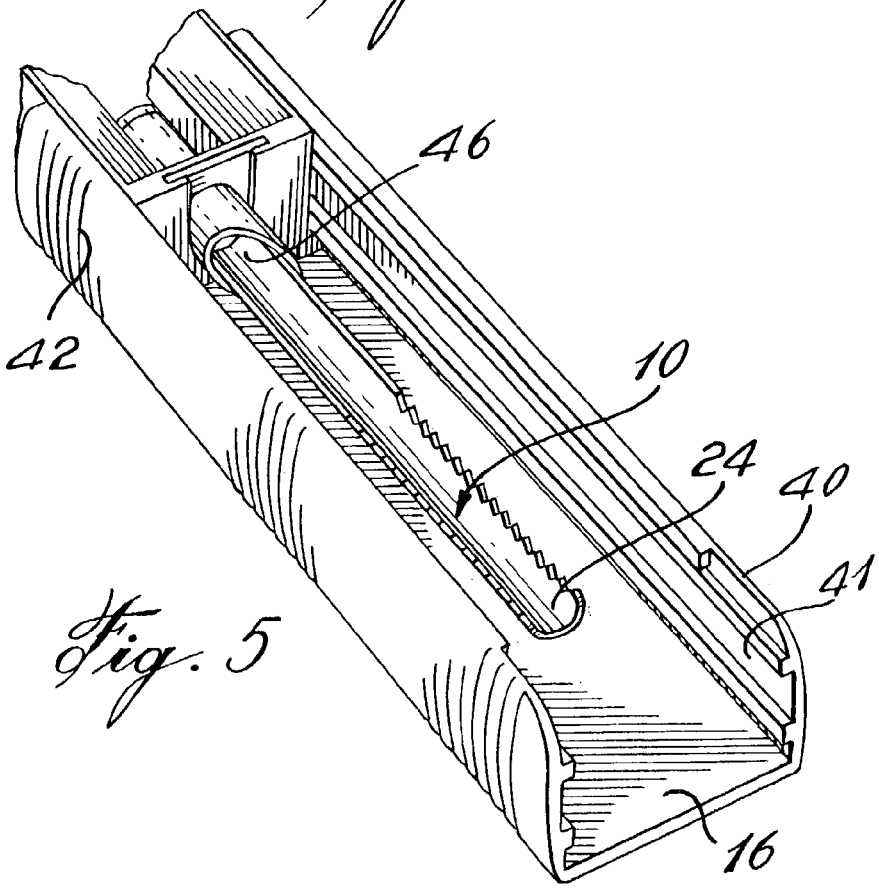
FIG. 5 is a perspective view showing the construction of the base.

An injection spoon 10 (see FIGS. 2 and 5) is secured within base 2 and is stationary therewith. The spoon which may be of metal or plastic is removably secured to the base to facilitate cleaning and/or replacement if necessary. The spoon 10 is retained elevated from the bottom wall 16 of the base, as shown in FIG. 5.

The tobacco receiving member 4 carries at its forward end a wall, herein a removable partition 18 (see FIGS. 2 and 6), which is received in slots 20 provided on both sides of the front end 4' of the tobacco receiving member 4. Secured to the partition 18 is a circular hollow nipple 22 which is adapted for insertion into the open end of a preformed paper cigarette tube 50, shown in phantom lines and well known in the art. The outer diameter of the nipple 22 is of a size to snugly receive the open end of a cigarette tube 50 thereover.

As partition 18 and nipple 22, which may be of plastic or metal as desired, are readily removable from the machine, cleaning and/or replacement is facilitated.

Because the injection spoon 10 is securely held by the base, and as partition 18 and nipple 22 are movable with the tobacco receiving member 4, rearward movement of the tobacco receiving member 4 with respect to the base 2 will result in the free end 24 of the spoon 10 passing through and extending beyond the nipple 22 and into the tube 50.

As shown in FIG. 2, the central portion of the tobacco receiving member 4 is provided with a top slot opening 26 with upper outwardly sloping surfaces 28. When the tobacco receiving member 4 is positioned forwardly within base 2 as shown in FIG. 2, the upwardly concave spoon 10 is positioned directly beneath the slot 26 and a quantity of tobacco sufficient for one cigarette is positioned within slot 26 and pushed downwardly into contact with the injection spoon 10. This positioning of the tobacco in the slot is facilitated by the inwardly sloping surfaces 28 and also through the use of a tamper device (not shown) and as described in my earlier patent.

As discussed above, the cover 6 is pivotally secured to the tobacco receiving member 4 and is movable from a closed position shown in FIG. 1 to an open position shown in FIG. 2. On its lower surface, the cover 6 is provided with a tobacco compacting projection 32 having a lower surface 34 which is concave in cross-section and which is of a size to be received within the slot 26 provided in the tobacco receiving member 4 when the cover is lowered to the position shown in FIG. 1. In this position, of course, the tobacco which is to be injected into a preformed cigarette tube is compacted and more or less shaped by confinement within a cavity formed by the upper concave surface of the spoon 10, the side walls of the slot 26 and the lower concave surface 34 of the tobacco compacting projection carried by the cover.

Figure 4:
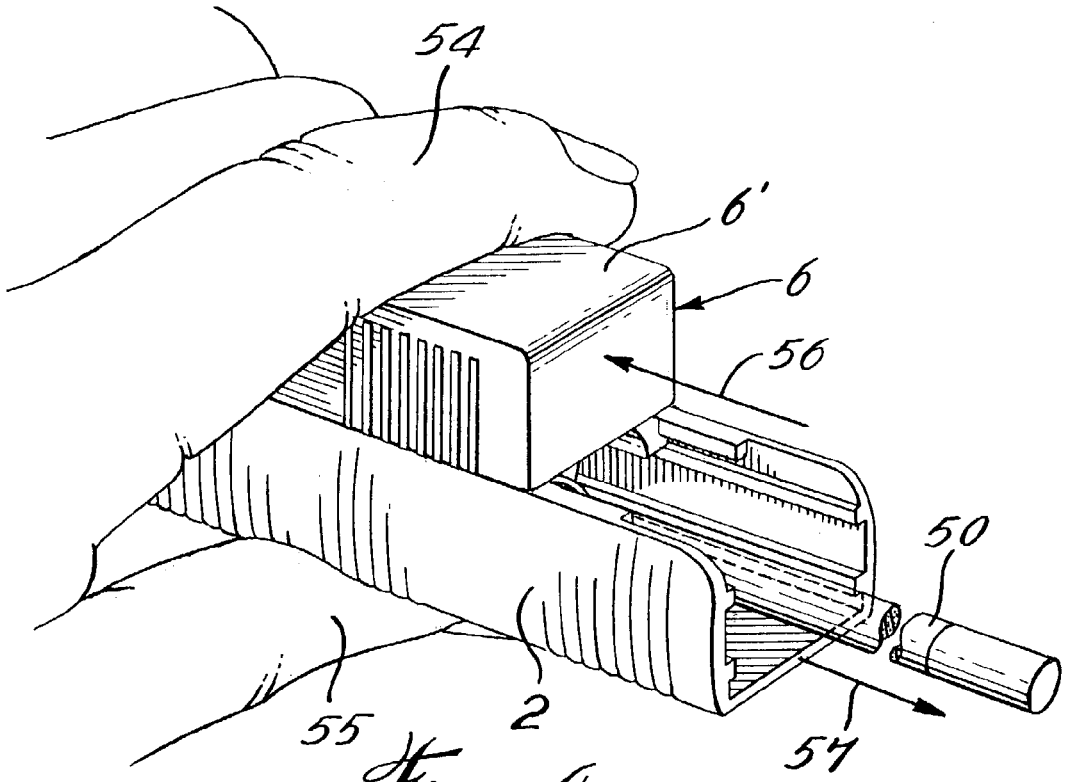
FIG. 4 is a perspective view showing how the cigarette making machine of the present invention is operable by a single hand of a user person.

The cover 6 is of the same width as the base 2 and together they form a compact, elongated, rectangular machine making it comfortable to grasp by the hand, as shown in FIG. 4 and can be operated by a single hand, if desired. It is also easy to carry by a user person.

Figure 3:
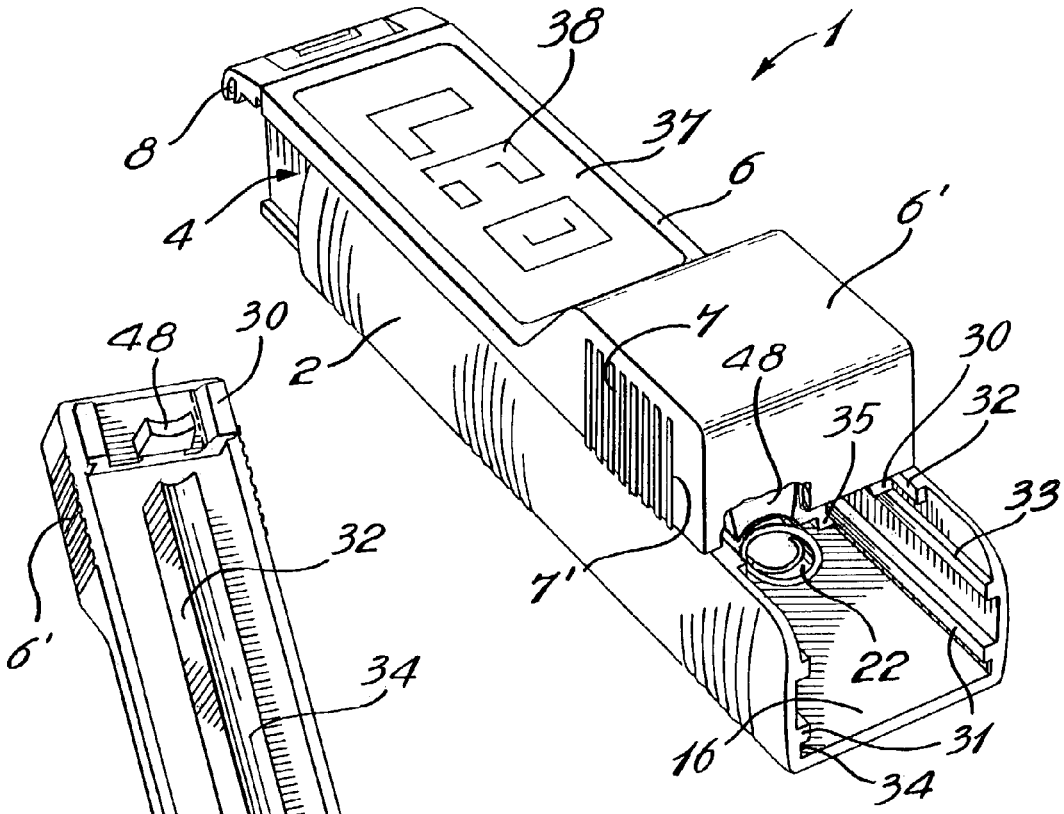
FIG. 3 is a perspective view of the cigarette making machine of the present invention and showing the tobacco receiving member partially retracted from the base.
Figure 6:
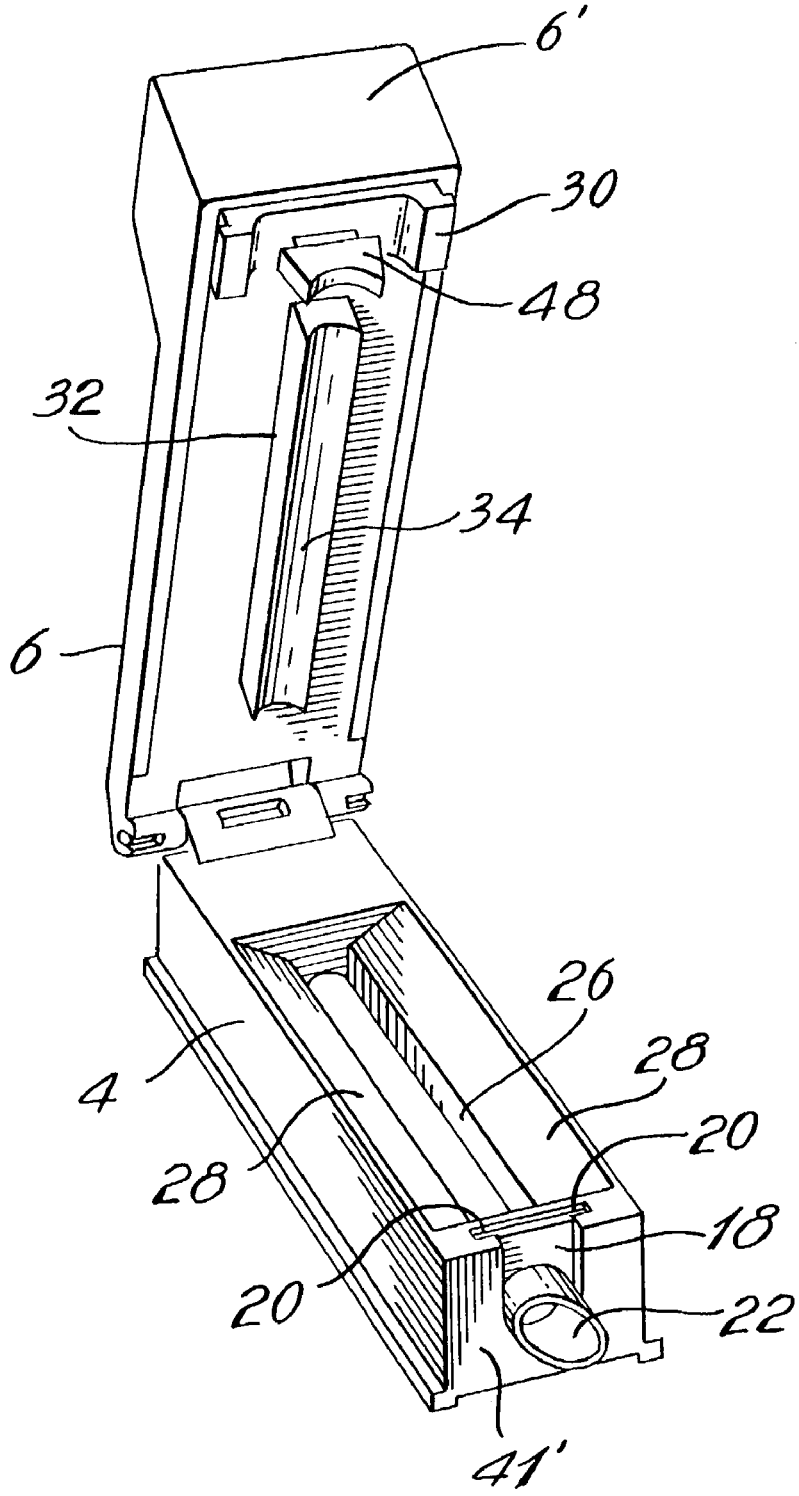
FIG. 6 is a perspective view of the tobacco receiving member which is slidingly secured within the base as shown in FIG. 5.

As shown in FIGS. 1 to 3, bottom slot retaining means in the form of opposed ribs 31 are formed with and extend adjacent the bottom wall 16 of the base whereby to retain captive thereunder, in the channel 34 formed between the ribs 31 and the bottom wall 16, a respective one of a pair of projecting feet 35 formed integral with the bottom corners of the tobacco receiving member 4. The forward end of the cover 6 has an enlarged section 6' which is provided with ribs 7 on opposed side wall 7' thereof for finger gripping engagement. A pair of opposed inner tongues 30 project from under the forward portion of the cover and are engagable under a respective elongated flange 32 projecting inside the open channel-shaped base and formed adjacent the top edge 40 of the side walls 41 of the base, as clearly shown in FIG. 5. A lower rib 33 is also provided spaced from the elongated flange 32 to form a guide channel therebetween. When the cover is in its forward position, as shown in FIG. 1, these tongues 30 are disposed forward of the channel 32 and therefore permitting the cover to be hinged outwardly to its loading position as shown in FIGS. 2 and 6. The side walls 41 of the base may also be provided with ribs 42 for ease of gripping.

With further reference to FIGS. 5 and 6, it is pointed out that in order to assemble the cigarette making machine, it is simply necessary to slide the tobacco receiving member 4 into the base from the forward end thereof with the cigarette tube retainer 10 extending thereunder and spaced above the bottom wall 16 of the base. The cover may then be assembled to the tobacco receiving member with the rear end of the cover having an abutment edge to abut the top rear edge 8" of the base member to prevent the tobacco receiving member from sliding forwardly out of the base.

During rearward movement of the cover 6 and tobacco receiving member 4 with respect to the base 7 as shown in FIG. 4, a compacted wad of tobacco is injected into a preformed cigarette tube 50 positioned on the nipple 22 (see FIG. 2). As shown in FIG. 5, the spoon 10 is provided with a stop or abutment 46 which ensures that the tobacco positioned on the spoon is carried into the cigarette tube.

A cigarette tube 50 is held in position on the nipple 22 by a cigarette tube retainer 48 provided on the underside of the cover and forwardly of the tobacco compactor 32 as shown in FIGS. 1 to 3. When a cigarette tube 50 is positioned on the nipple and the cover lowered, the cigarette tube retainer contacts the tip of the cigarette tube and holds the tube in position on the nipple during the injection process. Conveniently, the concave lower surface of the tube retainer may be provided with a thin soft layer 51 (see FIG. 1) of a compressible material such as sponge rubber or foam plastic to snugly secure the tube 50 onto the nipple without danger of tearing the cigarette paper tube.

To use the machine, the cover 6 is first opened to the position shown in FIG. 2, and the open end of a preformed cigarette tube 50 is positioned on the nipple 22. Then, with the tobacco receiving member 4 positioned completely within the base 2 as shown in FIG. 1, a supply of tobacco sufficient for one cigarette is placed into the tobacco receiving slot 26 and pressed into the slot either with the fingers or by using a tamper. The cover is then closed to the position shown in FIG. 1 wherein the cigarette tube retainer 48 contacts and holds the tip of a cigarette tube on nipple 22, as shown in FIG. 2. The base 2 of the machine is then held with one hand while the other hand slides the cover and the tobacco receiving member rearwardly with respect to the base to a fully retracted position. As discussed above, and as the injection spoon 10 is stationary with respect to the base and as the cigarette tube is carried rearwardly by nipple 22, the forward portion of the spoon and the wad of tobacco (not shown) enter the cylindrical cavity of the cigarette tube.

The cover is then moved forwardly with respect to the base to the forward position shown in FIG. 1 retracting the spoon only form the tube 50, and the cover raised (see FIG. 2) to remove the tube retainer 48 from the cigarette tube 50 to permit removal of the filled cigarette from the nipple.

As previously described, because of the compactness of the design, a cigarette may be formed using a single hand, as shown in FIG. 4. The index finger 54 is positioned over the enlarged front end 6' of the cover and the thumb 55 under the base. The cover 6 is pulled back in the direction of arrow 56 while the thumb 55 pushes the base 2 forward in the direction of arrow 57.

Figure 7:
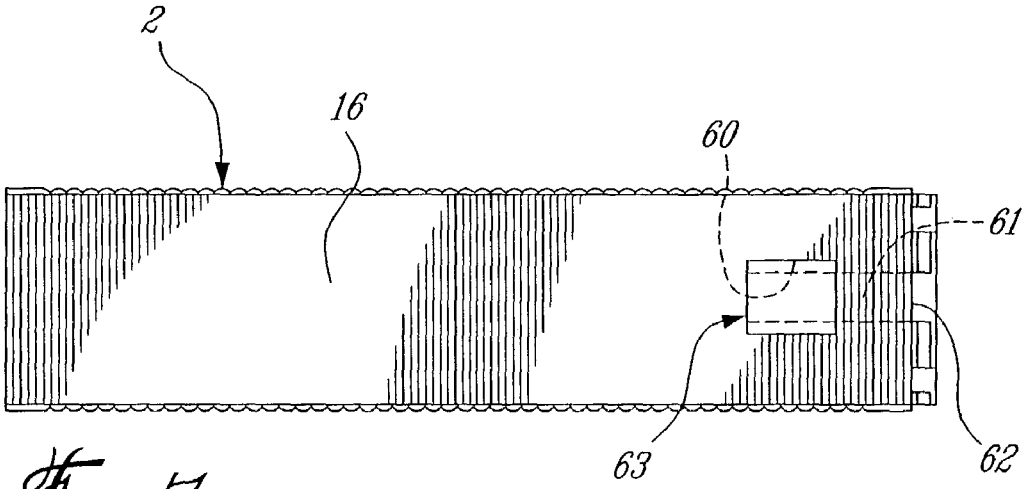
FIG. 7 is a bottom view of the base member of the cigarette making machine.
Figure 8:
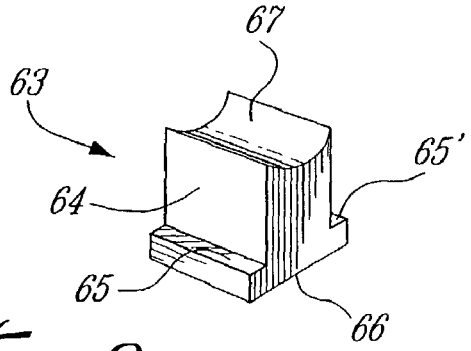
FIG. 8 is a perspective view of the removable abutment insert.

Referring now to FIG. 7, there is shown a bottom view of the base 2 and wherein the bottom wall 16 is provided with a rectangular aperture 60 adjacent an abutment wall or abutment projection 61 projecting inwardly between the vertical side walls of the base 2 and at the rear end 62 of the base. A removable abutment insert 63, as shown in FIG. 8, is frictionally engageable within the aperture 60. The abutment insert is formed of plastics material and dimensioned for close friction fit within the aperture 60 and it defines a rectangular projecting body 64 provided with opposed flanges 65 and 65' projecting from a lower surface 66 thereof. The flanges 65 and 65' constitute finger engaging means when the abutment insert 63 is held captive within the aperture. The flanges 65 and 65' abut against the bottom wall 16 of the base 2 on opposed longitudinal sides of the aperture 60. The upper surface of the rectangular projecting body 64 has a concavity 67 therein to permit the passage of an arresting projection 68 (see FIG. 9) projecting from a lower end of a front wall 69 of the tobacco receiving member 4.

Figure 9:
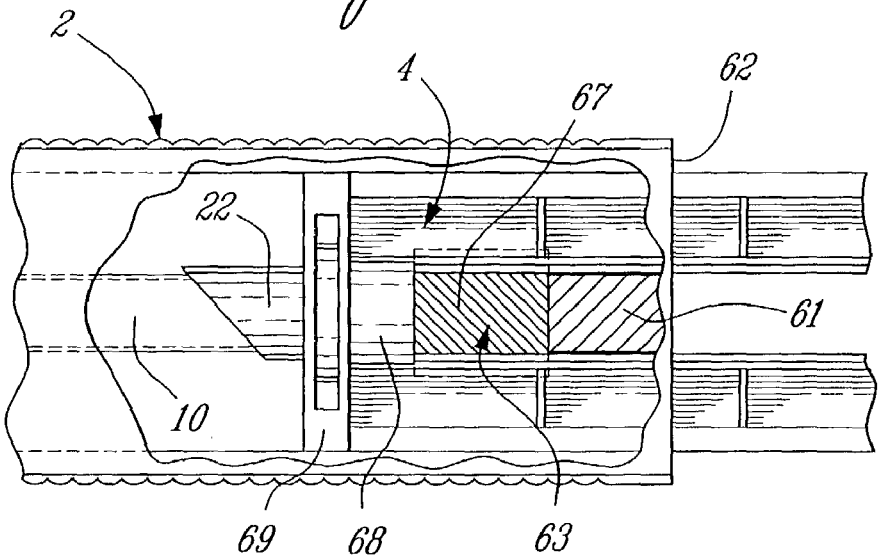
FIG. 9 is a partly fragmented bottom view showing the tobacco receiving member fully retracted and against the abutment insert.

As shown in FIG. 9, the insert 63 is hereinshown in phantom lines whereby to indicate its position with respect to the abutment wall 61 and the arcuate arresting projection 68. As shown in FIG. 9, with the insert 63 in position, the front wall 69 of the tobacco receiving member 4 is arrested a predetermined distance from the abutment wall 61. This distance is equivalent to the difference between the length of two different length cigarette tubes to be injected by the same machine as will be described hereinbelow.

Figure 10:
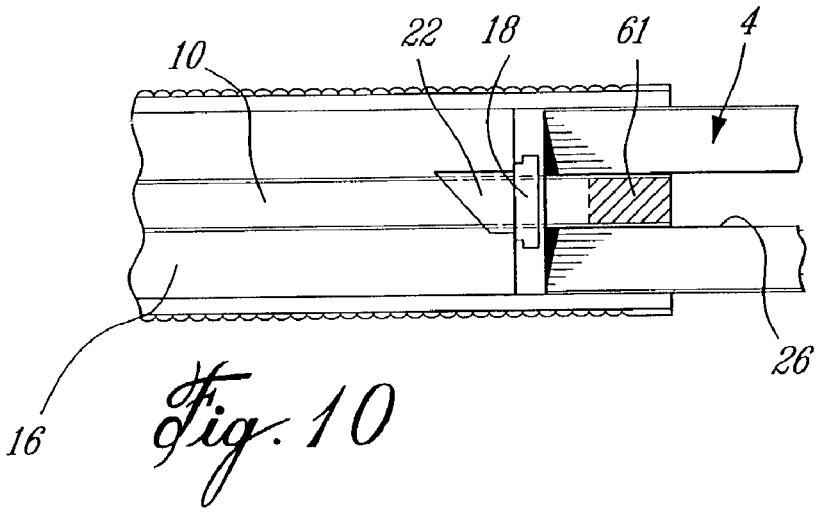
FIG. 10 is a fragmented top view showing the tobacco receiving member fully retracted without the abutment.
Figure 11:
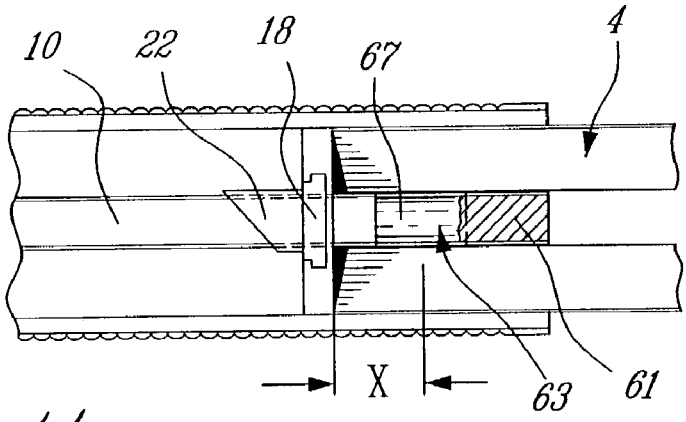
FIG. 11 is a view similar to FIG. 10 but showing the tobacco receiving member fully retracted but with the abutment in place.
Figure 12:
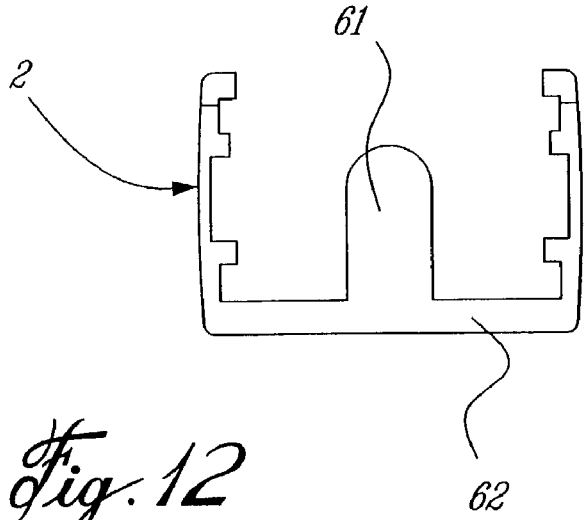
FIG. 12 is a rear view of the base showing the position and configuration of the abutment wall formed integral with the base.

With additional reference now to FIGS. 10, 11 and 12, there is shown in FIGS. 10 and 11 top views of portions of the cigarette making machine which illustrates the rearward displacement of the tobacco receiving member 4 without the insert in FIG. 10 and with the insert in FIG. 11. When the insert is in position, as shown by the phantom lines 63 in FIG. 9, the rearward travel distance of the tobacco receiving member 4 is shorter than when the insert is removed. Accordingly, longer cigarette tubes can be compacted with tobacco using the same machine. It is also pointed out that the length of the injection spoon 10 is dimensioned to hold tobacco for injection in the longer cigarette tubes. Accordingly, when the insert is in position, and shorter tubes are to be filled, the spoon exposes a shorter opening to receive tobacco therein. Although not limited thereto, the cigarette making machine of the present invention was designed to receive an insert permitting cigarettes of 84 millimeter and 100 millimeter lengths to be filled with compacted tobacco.

Figure 13A:
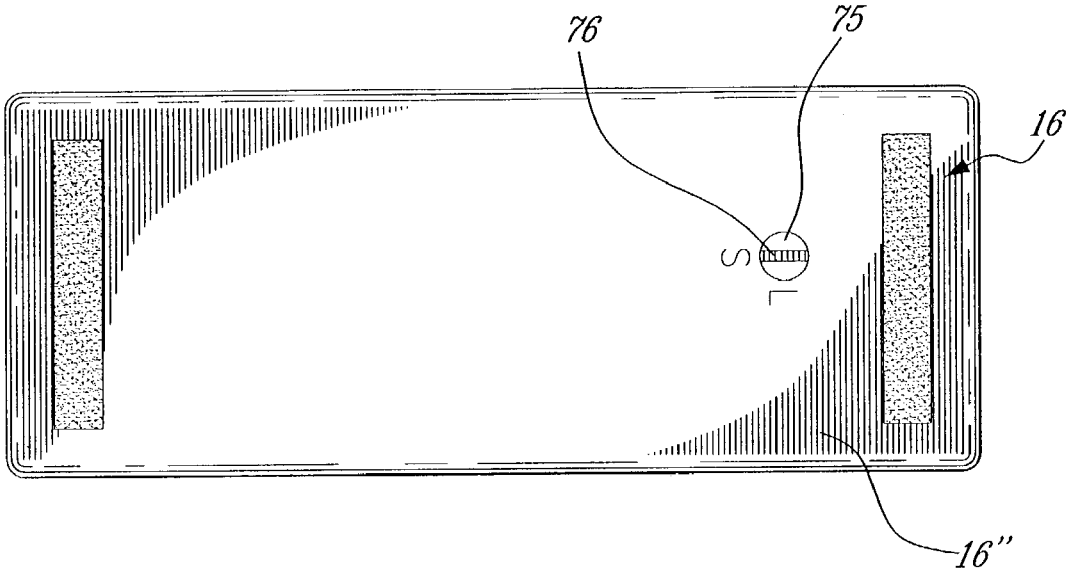
FIG. 13A is a fragmented view of the outer surface of the bottom wall adjacent the rear end edge thereof showing the position of the adjustment means for displacing the pivotal stop member.
Figure 13B:
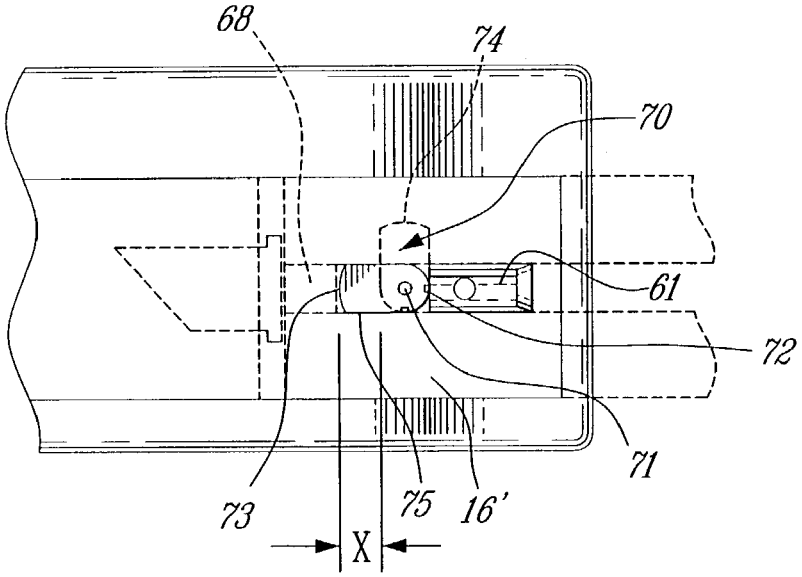
FIG. 13B is a fragmented top view showing the position of the pivotal stop member with respect to the arresting projection.

Referring now to FIGS. 13A and 13B, there is shown a further embodiment of the arresting means wherein it is hereinshown as being constituted by a pivotal stop member 70. The pivotal stop member is disposed over an inner surface 16' of the bottom wall 16 and is displaceable thereover on a pivot 71. As hereinshown, the pivotal stop member is a rectangular arm with the pivot 71 disposed adjacent a rear end 72 thereof which is in close proximity to the abutment wall 61. The pivotal arm 70 is displaceable from an axially aligned position, as shown in solid line, and wherein a free front end 73 thereof faces the abutment means or the arresting projection 68 whereby to accommodate cigarette tubes of shorter length. When the pivotal arm 70 is displaced to a transverse position, as shown in phantom lines at 74, the side edge 75 thereof faces the arresting projection 68 to accommodate cigarette tubes of longer length.

As shown in FIG. 13A, the pivot 71 has an engageable free end 75 which is accessible from the outer surface 16" of the bottom wall 16 under the cigarette making machine. The engageable free end 75 has a slot 76 for engagement by a screwdriver tool whereby to displace the pivotal arm 70 to its two positions as illustrated in FIG. 13B. Imprinted on the outer surface 16" is the letter "S" and the letter "L" disposed at ninety (90) degrees from one another whereby to indicate the direction of the slot 76 in order to accommodate cigarette tubes which are small or large.

It is within the ambit of the present invention to is cover any obvious modifications provided these fall within the scope of the appended claims.

I claim:

1. A compact cigarette making machine for compacting and inserting a quantity of tobacco into a preformed cigarette tube, said machine comprising a base of upwardly open channel shape having forward and rearward ends and an elongate tobacco injection spoon having a free end and having a concave cross-section secured at a predetermined elevated position within the base and stationary therewith, and a tobacco receiving member slidably retained within the base and movable to a position extending longitudinally outwardly from the rearward end of the base, the tobacco receiving member having at its forward end a wall carrying a hollow circular nipple to receive the open end of a preformed cigarette tube, the free end of the injection spoon passing through the hollow nipple during rearward movement of the tobacco receiving member with respect to the base, an abutment means associated with said rearward end of said base to arrest the travel of said tobacco receiving member, and an elongate slot provided in and extending through the tobacco receiving member to receive a quantity of tobacco, and a cover pivotally secured to the tobacco receiving member and slidable therewith with respect to the base, the cover being pivotally movable from an open position to a closed position overlying the tobacco receiving member, and a tobacco compacting projection having a lower surface which is concave in transverse cross-section carried by the cover and which closes a top portion of the said elongate slot when the cover is in closed position to compact tobacco inserted in said slot and onto said tobacco receiving member, a cigarette tube retainer having a circular concave surface on the cover forwardly of the tobacco compacting projection, the concave surface of the retainer bearing against a cigarette tube positioned on the nipple to hold the tube in position during tobacco injection, retaining means in a lower portion of said base for slidingly engaging said tobacco receiving member, said cover having a pair of opposed inner tongues engagable under a respective elongated projection inside said open channel shape base from opposed side walls thereof when said tobacco receiving member is retracted rearwardly over said base, and arresting means disposed over an inner surface of a bottom wall and spaced from said rearward end thereof for contact with an arresting projection of said tobacco receiving member to shorten the rearward displacement of said tobacco receiving member whereby cigarette tubes of a shorter predetermined length can be used with the same cigarette making machine.

2. A compact cigarette making machine according to claim 1 wherein said arresting means is constituted by a removable abutment insert positionable in an aperture formed in said bottom wall and spaced from said rearward end thereof.

3. A compact cigarette making machine according to claim 2, wherein said aperture is formed in said bottom wall adjacent to said abutment means, said abutment insert being frictionally retained in said aperture and projecting in said open channel shape base in front of said abutment means.

4. A compact cigarette making machine according to claim 3, wherein said abutment insert is a rectangular projecting body having opposed flanges projecting from a lower surface thereof, said flanges constituting finger-engaging means, said aperture being a rectangular aperture.

5. A compact cigarette making machine according to claim 4, wherein an upper surface of said rectangular projecting body has a concavity to permit passage of an arresting projection projecting from a lower end of a front wall of said tobacco receiving member.

6. A compact cigarette making machine according to claim 5, wherein said abutment insert has a predetermined length equivalent to the difference in length between two different length cigarette tubes to be filled with tobacco.

7. A compact cigarette making machine according to claim 1, wherein said wall carrying a hollow circular nipple is a removable partition.

8. A compact cigarette making machine according to claim 1, wherein said abutment means is an abutment wall.

9. A compact cigarette making machine according to claim 1, wherein said arresting means is constituted by a pivotal stop member having two arresting surfaces and pivotally secured over an inner surface of said bottom wall on a pivot, and adjustment means to displace said pivotal stop member on said pivot to position one of said two arresting surfaces for arresting contact with said arresting projection.

10. A compact cigarette making machine according to claim 9, wherein said pivotal stop member is a pivotal rectangular arm with said pivot disposed adjacent a rear end of said arm, said arm being displaceable from an axially aligned position wherein a free front end thereof faces said arresting projection to accommodate cigarette tubes of shorter length, to a transverse position wherein a side edge thereof faces said arresting projection to accommodate cigarette tubes of longer length.

11. A compact cigarette making machine according to claim 9, wherein said adjustment means is an engageable free end of said pivot accessible from an outer surface of said bottom wall under said cigarette making machine.

12. A compact cigarette making machine according to claim 11, wherein said engageable free end is a slotted free end for engagement by a screwdriver tool.

* * * * *